US005592770A

United States Patent [19]

Gudgel

[11] Patent Number: 5,592,770

[45] Date of Patent: Jan. 14, 1997

[54] SHOTGUN MOUNTED LAUNCHING DEVICE AND LAUNCHING PROJECTILE

[76] Inventor: John Gudgel, 840 N. Oswego, Tulsa, Okla. 74115

[21] Appl. No.: 666,756

[22] Filed: Jun. 19, 1996

[51] Int. Cl.[6] ..... F41C 27/06

[52] U.S. Cl. ..... 42/105; 89/134

[58] Field of Search ..... 42/105, 1.15; 89/1.34; 441/85; 102/504

[56] References Cited

U.S. PATENT DOCUMENTS

| | | | |
|---|---|---|---|
| 2,335,299 | 11/1943 | Moore | 42/105 |
| 2,883,781 | 4/1959 | Harvey | 42/105 |
| 3,004,360 | 10/1961 | Johnson | 42/105 |
| 3,007,271 | 11/1961 | Brandt | 42/105 |
| 3,186,119 | 6/1965 | Maras et al. | 42/105 |
| 3,243,909 | 4/1966 | Kotikov | 42/105 |
| 3,392,469 | 7/1968 | Dubini | 42/105 |
| 3,496,580 | 2/1970 | Gulmon | 42/105 |
| 3,505,926 | 4/1970 | Johnson | 89/1.34 |
| 3,534,492 | 10/1970 | Amster | 42/105 |
| 3,618,244 | 11/1971 | Johnson | 42/1.14 |
| 3,717,946 | 2/1973 | Chavee | 42/105 |
| 4,154,013 | 5/1979 | Stilwell | 42/105 |
| 4,341,030 | 7/1982 | Little | 42/105 |

FOREIGN PATENT DOCUMENTS

| | | | |
|---|---|---|---|
| 124799 | 4/1919 | United Kingdom | 102/504 |
| 189346 | 11/1922 | United Kingdom | 102/504 |

*Primary Examiner*—Stephen M. Johnson
*Attorney, Agent, or Firm*—William S. Dorman

[57] ABSTRACT

A device for training retrieving dogs comprising of a launcher device (19) made to fit within the discharge end of a shotgun barrel (17) of standard construction equipped with a internal thread socket (16) made to receive replacement choke tubes by means of the external thread socket (10) of the choke-mount adapter shaft (5) to launch a projectile (21)to simulate a shot game bird for the dog to retrieve in order to build and refine the skills of a field working Gun Dog by incorporating the shotgun (21) in the training process.

5 Claims, 2 Drawing Sheets

SHOTGUN MOUNTED LAUNCHING DEVICE AND LAUNCHING PROJECTILE

BACKGROUND-FIELD OF INVENTION

Figure 1:
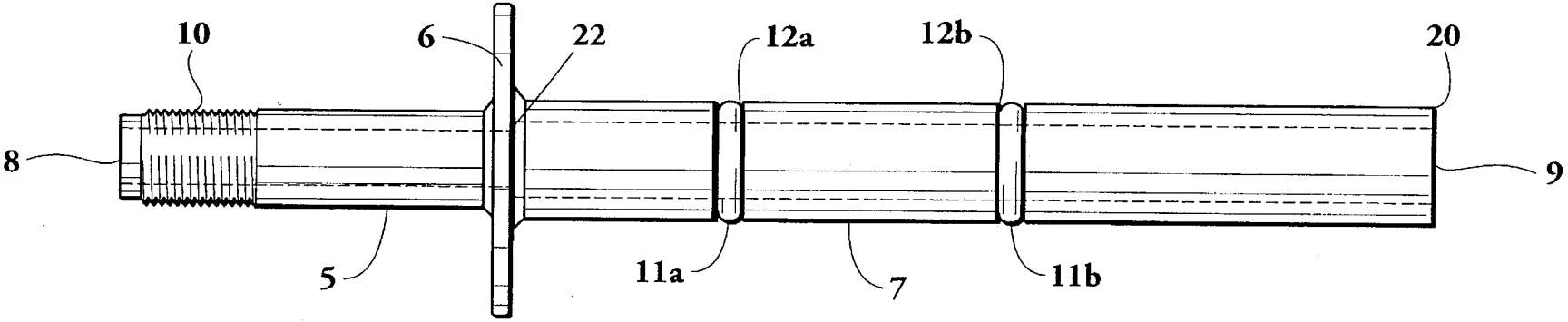

This invention relates in general to improvements in launching device attachments for firearms, more particularly to devices mounted directly into a shotgun barrel by means of the factory or privately installed internal interchangeable choke system of any gauge shotgun.

BACKGROUND-DESCRIPTION OF PRIOR ART

Numerous projectile gun devices have been proposed or utilized to launch a projectile and simultaneously produce an explosive report to simulate a shotgun report in training retrieving dogs in order to build the animal's experience and confidence in a hunting type situation. Exemplary of devices of this general type are those illustrated in U.S. Pat. Nos. 3,505,926; 4,154,013 and 4,341,030. Models such as U.S. Pat. No. 3,505,926 comprise an elongate launching guide having a chamber for receiving a single 0.22 caliber blank cartridge as a explosive propellant. A hinge joint connects the base of the launcher guide to a breech-block plate which closes the rear of the chamber and has a handle extending rearwardly from and coaxially with the guide when the chamber is closed and the device is ready for firing. A latched hinge must also be griped by the operator during firing to keep the chamber from opening when the propellant charge is exploded. This style of projectile gun is van, awkward to operate and because of the coaxial alignment of the handle and guide the launcher must be held at the operators side when discharged and even when a glove is worn on the hand used to operate this device the crude arrangement of the securing latch and handle can result in bruising or laceration of the hand in which the device is held.

U.S. Pat. No. 4,154,013 to Stilwell (1979) and U.S. Pat. No. 4,341,030 to Little (1982) both illustrates a device in which a male cylindrical elongated launcher guide with an affixed gas deflector shield to which is affixed a reduced diameter replacement barrel with externally threaded cylindrical socket at the rearwardmost end allowing it to be screwed into an elongate, internally threaded cylindrical socket of the frame of the 0.22 caliber starter's pistol, the device must then be further more secured to the frame by means of a retaining pin fitted lockingly through a hole in the starter's pistol frame and a corresponding notch in the rear portion of the launching guide, the hole tangential intersecting the socket to prevent undesired loosing. Changing from the original barrel to the launching devise becomes a real burden and requires special tools to remove the locking pin from the frame of the starter's pistol and the launching device, also the locking pin has a tendency to bend, break, or jam upon removal or upon entry and could cause possible permanent damage to the pistol frame or to the launching device it's self. After repeated changing of the barrel to the launching device, the retaining pin hole in the pistol frame and the retaining pin notch in the rearwardmost end of the launcher become over sized and undesirable loosening of the barrel occurs and renders both devices irreparable and useless.

The main and most important object of devices of the general type hereinbefore discussed which produce an explosive report and simultaneously launch a projectile for a dog to locate and retrieve is to simulate the explosive report of the shotgun that will be used in the real hunting field so that the dog will become accustomed to the sound of the shotgun being discharged and associate that sound to the act of retrieving. The explosive report produced by the 0.22 caliber blank used by devices of the general type hereinbefore discussed give a very poor and inadequate simulation of the explosive report produced by a large gauge shotgun such as a 12 gauge or a 20 gauge which is common when hunting fowl. This is a major disadvantage of the prior art forms. When devices of the general type hereinbefore discussed are employed to train and prepare a hunting dog to retrieve downed fowl it is inevitable that a large gauge shotgun of the type common to the hunting of fowl also be introduced to the dog in the training process before the dog ever enters the hunting field. Using the prior art forms this would then require two people to conduct the training, one person to launch the projectile with one of the previous type prior art devices and one person to simultaneously discharge the shotgun. This is another major disadvantage of the devices of the general type hereinbefore discussed. With the use of the present invention (the shotgun mounted launcher and launching projectile) this major disadvantage of the prior an can be overcome. By creating a launching device, made adaptable, to easily inter-thread into the discharge end of the barrel of the trainers own shotgun, or any readily available shotgun, in trainers preferred gauge of choice, by means of the factory or of a privately installed interchangeable choke system. Another major disadvantage of the prior an forms is their inability to launch larger projectiles to simulate size and weight of larger game birds such as duck, pheasant, and goose which are common type fowl the dog will be required to retrieve.

OBJECTS AND ADVANTAGES

By incorporating the shotgun to launch the retrieving projectile in the training process much larger and heavier projectiles can be used so that the dog can become better accustomed to the size and weight of fowl he will be expected to retrieve.

It is very important when hunting fowl with a retrieving dog that the dog posses the ability to visually locate a shot fowl while falling so as to mark it's location in order to conduct a fast and effective retrieval of said shot fowl upon the hunter's command. This skill which prior to the present invention could only be developed and achieved through the dog's own repeated experiences working with the shotgun in a real hunt. Since the hunting season last only a brief few weeks each year it could take several years for the dog to develop this very important skill.

It is therefore an object of the present invention to employee the use of a real shotgun to create a gun and projectile visual training for the dog, by repeated usage of the shotgun to launch the projectile in training the dog learns quickly and effectively to visually locate the falling projectile by noting the direction in which the operator is pointing the barrel of the shotgun when discharged, this makes the dog a much more efficient and effective field working retrieving dog by giving him the ability to locate falling birds in the same manner.

Another object of the present invention is to create a virtual hunting type situation for the dog so he will be comfortable, confident, and experienced when he enters the field in a real hunt.

Another object of the present invention is to allow the operator to better place the projectiles flight path by allowing the operator to aim the projectile in the same manner that he would normally aim the shotgun to shoot.

Another object of the present invention is to allow the operator to launch larger projectiles to simulate the size and weight of larger game birds such as ducks, pheasant, and goose which can not be done by the prior an forms.

Another object of the present invention is to create a launching device which has no internal working parts to wear out, break, or malfunction.

Another object of the present invention is to create a realistic hunting type training process for the dog developing on his most basic senses sight and sound.

Another object of the present invention is to create a launchable decoy type projectile which will be made of a soft durable vinyl, nylon, or plastic type compound and to be shaped in such a manner as to look like a real game bird.

Another object of the present invention is to create a launching device which can be made to easily inter-thread into the discharge end of a standard readily available shotgun equipped with a interchangeable choke system.

The shotgun is the most important tool in the development of a field working retrieving dog and must be incorporated in the training process. With the use of the present invention (shotgun mounted launcher and launching projectile) the trainer uses the shotgun fight from the start of training and eliminates the:

Time, effort, and inconvenience of converting from a prior art type launcher to the real shotgun which MUST be done Inconvenience of having to acquire the assistance of a second person to aid in the introduction of the shotgun (one person must launch the projectile by use of a prior art form type launcher and the second person must discharge the shotgun). This is a very confusing situation for the dog.

The present invention (shotgun mounted launcher and the molded life-like (size, weight, shape, and color) soft vinyl or plastic decoy type launchable projectile create a realistic hunting situation for the dog developing on his most basic senses sight and sound. By using a real shotgun to launch the projectile the dog learns to work directly with the shotgun in training the same way he will work while in the hunting field. By repetitive training with the present invention the dog quickly learns that when the trainer puts the shotgun to his shoulder and fires the shotgun a launching projectile will fall in the direction in which the shotgun barrel is pointing and he will visually scan that area and locate the falling projectile and mark it's location on a real hunt when the trainer or hunter shoulders his shotgun and fires, the dog will automatically scan the area in which the shotgun barrel is pointing when discharged, to locate the falling bird in the exact manner as the training exercises, the only difference being the real game bird as opposed to the launching projectile.

REFERENCE NUMERALS IN DRAWINGS

5 choke-mount adapter shaft

6 disc-shaped shield plate

7 male cylindrical launching tube

8 choke-mount adapter shaft central bore

9 male cylindrical launching tube central bore

10 choke-mount adapter shaft external thread socket

11*a* "O"-ring

11*b* "O"-ring

12*a* circumferential groove

12*b* circumferential groove

13 female cylindrical launching tube

14 molded outer shell of projectile

15 locking blast plate

16 internal thread socket of the shotgun barrel's interchangeable choke system

17 discharge end of shotgun barrel

18 rearwardmost open end of female cylindrical launching tube

19 launcher device

20 standard readily available shotgun

21 projectile

22 central hole

DRAWING FIGURES

FIG. 1 is an elevational view of the preferred embodiment of the launcher according to this invention, it is seen that the preferred embodiment of the launcher device of the present invention is comprised of a linearly extending choke-mount adapter shaft 5. The rearwardmost portion of the choke-mount adapter shaft 5 is a radially extending external choke-mount adapter thread socket 10. Choke-mount adapter shaft 5 has a longitudinal bore 8 extending therethrough. At the forwardmost end of the choke-mount adapter shaft 5, is affixed a disc-shaped shield plate 6, to which is affixed an increased diameter male cylindrical launching tube 7. The male cylindrical launching tube 7 has a increased diameter longitudinal bore 9 extending therethrough. The disc-shaped shield plate 6 has a central hole 22 which is sized to align with central bore 8. The male launching tube 7 includes two circumferential grooves 12*a* and 12*b* which are spaced along the male cylindrical launching tube 7 at preselected locations between the discharge end 20 and the disc-shaped shield plate 6. To each circumferential groove 12*a* and 12*b* an "O"- ring 11*a* and 11*b* are sized to fit within each groove.

Figure 2:
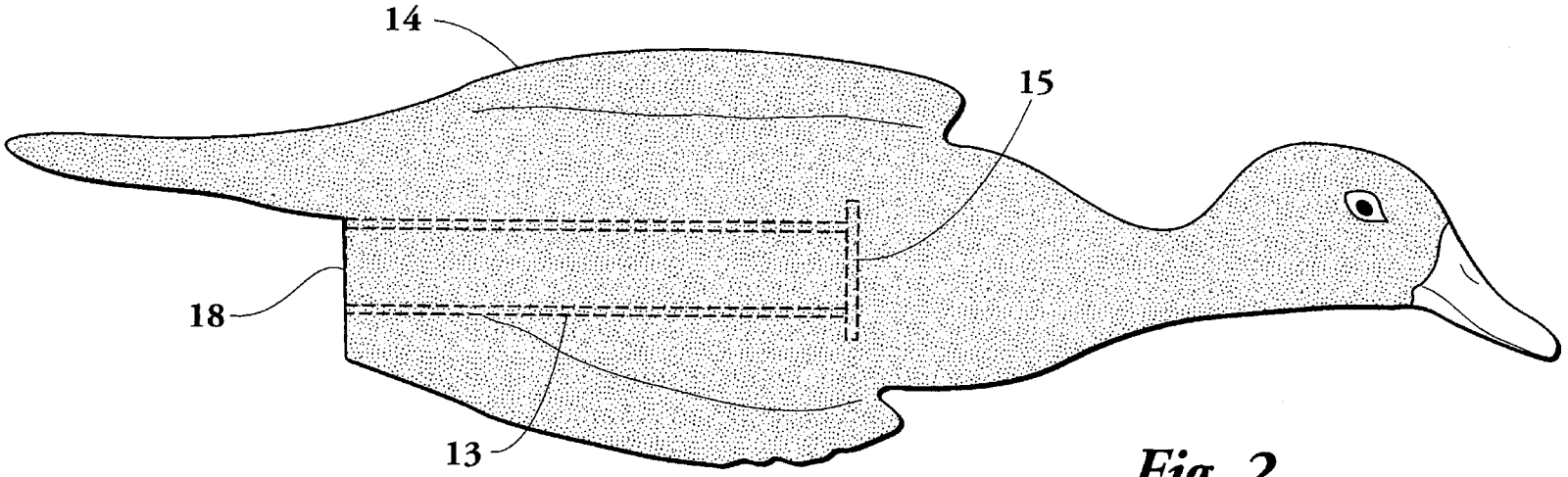

FIG. 2 is an elevation view of the preferred embodiment of the projectile according to this invention, it is seen that the preferred embodiment of the projectile of the present invention is comprised of a female cylindrical launching tube 13, which is open at the rearwardmost end 18, and closed at the forwardmost end by means of the affixed locking blast plate 15. The female cylindrical launching tube 13, with the affixed locking blast plate 15 is molded inside a soft durable vinyl or plastic outer shell 14, which is molded in such a way as to resemble a real dead game bird. The locking blast plate 15 serves to keep the female cylindrical launching tube 13 firmly locked inside the outer shell 14, while also protecting the inside of the projectile's outer shell 14 from the extreme temperature of the blank shotgun shell propellant.

Figure 3:
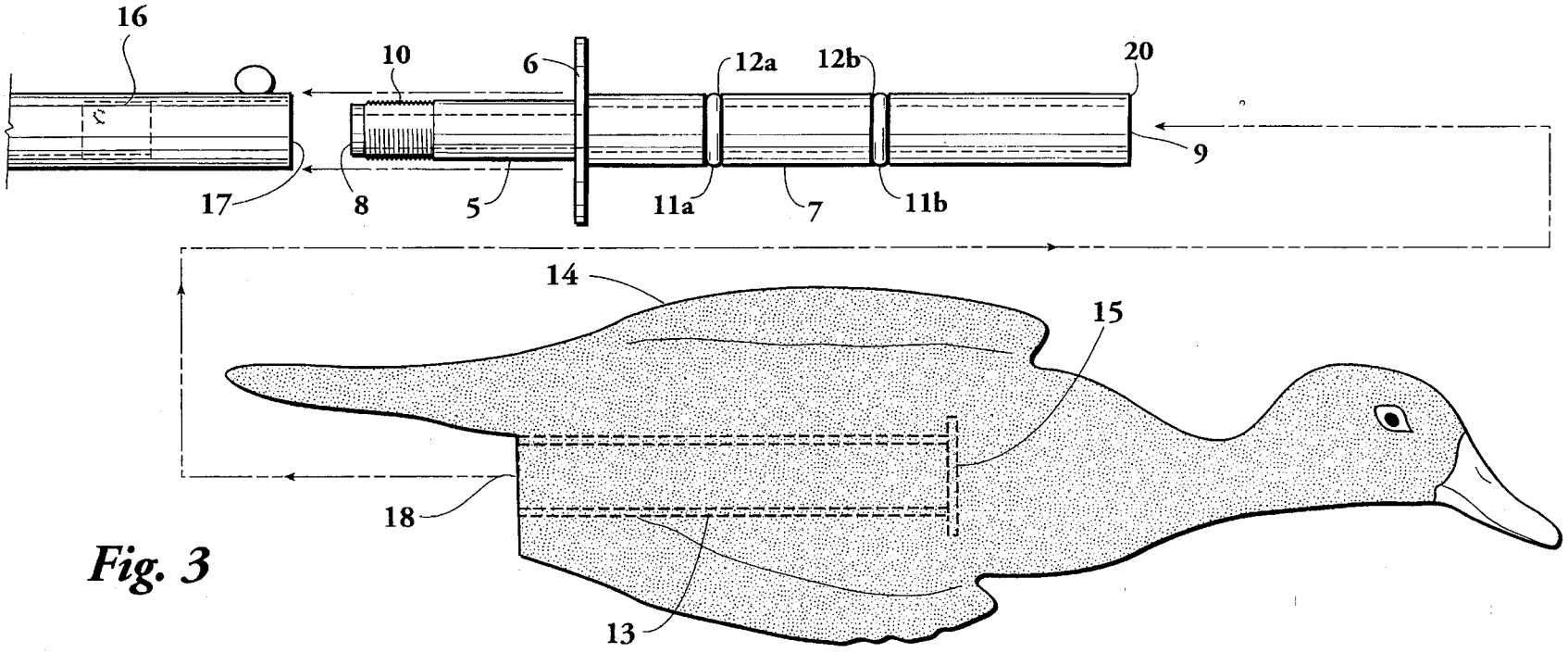

FIG. 3 is an exploded view showing the in-use application of the present invention, including the discharge end portion of a standard readily available shotgun barrel 17 equipped with a interchangeable choke system, and the internal thread socket 16 made to receive readily available interchangeable replacement screw-in choke tubes, the screw-in choke tube thereof having been removed. The launching device of the present invention shown positioned to be inserted through the discharge end of the shotgun barrel 17 and screwed into the internal thread socket 16 by means of the external thread socket 10 of the choke-mount adapter shaft 5 of the present invention. The male cylindrical launching tube 7 of the present invention is shown positioned to receive the female cylindrical launching tube 13, to which having a mouth and internal surface generally complementary with and only slightly oversized with respect to the outside surface of the male cylindrical launching tube 7. Each "O"-ring 11*a* and 11*b* are sized to fit within each circumferential groove 12*a* and 12*b* of the male cylindrical launching tube 7 and to be compressed by the inside surface of the female cylindrical launching tube 13 so as to provide a snug, but not binding, fit between the male cylindrical launching tube 7 and the female cylindrical launching tube 13 when the projectile is slipped onto the male cylindrical launching tube 7 in the launch ready position.

Figure 4:
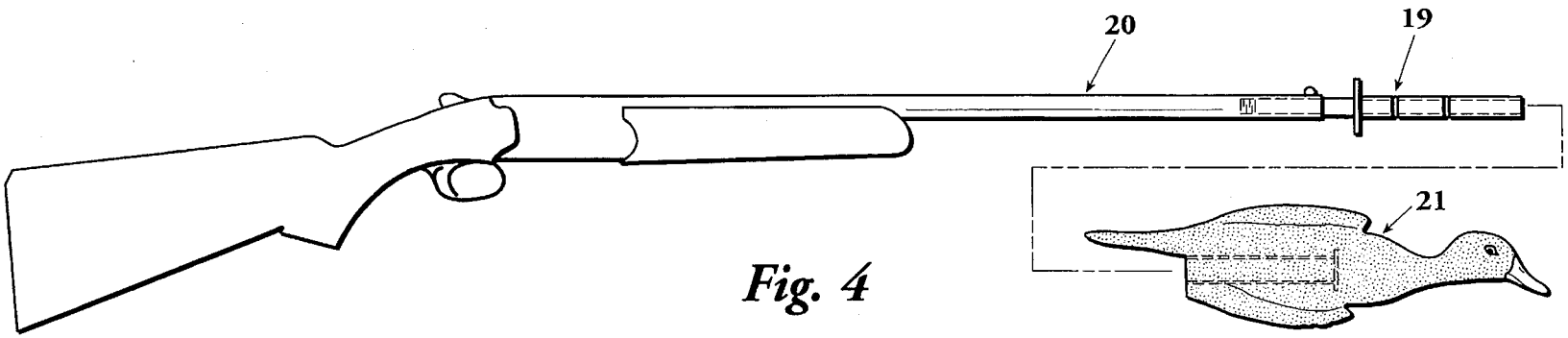

FIG. 4 is an elevational view showing the launching device generally designated by numeral 19 mounted into the discharge end of a standard readily available shotgun generally designated by numeral 20 by means according to the description and drawing of FIG. 3 of the present invention. The projectile in FIG. 4 generally designated by numeral 21 is shown positioned to be slipped onto the launching device 19 by means according to the description and drawing of FIG. 3.

FIG. 4 The shotgun 20 is of standard construction and operation. The blank shotgun shell cartridge propellant is engaged into the discharge station of said shotgun 20 in the manner conventional for shotgun type firearms.

FIG. 3 when the propellant cartridge is discharged in the manner conventional for firing a shotgun of standard construction and operation the propellant gas charge of the blank shotgun shell cartridge expands forward through the choke-mount adapter shaft central bore 8 further through the increased diameter male cylindrical launching tube central bore 9 into the interior of the female cylindrical launching tube 13 and against the exposed portion of the affixed locking blast plate 15. Such expansion of said propellant charge sends the projectile forward into ballistic flight.

SUMMARY, RAMIFICATIONS, AND SCOPE

Accordingly, the reader will see that the launcher device of the present invention can easily and conveniently mount into or be removed from the shotgun barrel's interchangeable choke system allowing the trainer to incorporate the use of a shotgun common to the hunting of fowl directly into the training process. Furthermore, the shotgun mounted launching device and launching projectile have the additional advantages in that

- It totally eliminates the time, effort, and inconvenience of converting from a prior art type launcher to a real shotgun
- It eliminates the inconvenience of having to acquire the assistance of a second party to aid in the introduction of the shotgun (one party must launch the projectile by use of a prior an form type launcher and the second party must discharge the shotgun).
- It allows the projectile to be launched a greater amount of distance.
- It allows the dog to build a working relationship with the same shotgun in the training process as in the hunting field.
- It allows the trainer to launch larger projectiles to simulate larger game birds which are common for the dog to retrieve in the hunting field.
- It allows the trainer to better place the projectiles flight path by allowing the trainer to aim the projectile in the same manner that he or she would normally aim to shoot the shotgun.
- It provides a launching device which has no internal working parts which may wear out, malfunction, or break (other than inexpensive replacement rubber "O"-rings).

Although the description above contains many specificity's, these should not be construed as limiting the scope of the invention but as to merely providing illustrations of some of the presently preferred embodiments of this invention. For example, both the female and male cylindrical launching tubes can have other shapes such as square, triangular, oval, etc. tube type configurations; the projectile could serve as a rescue type device such as a life buoy, or a rescue hook with attached cord or line. The male launching tube could have several radially extending annular grooves to accommodate a plurality of "O"-rings.

Thus the scope of the invention should be determined by the appended claims and their legal equivalents, rather than by the examples given.

What is claimed is:

1. A launching device for a shotgun for use in training retrieving dogs wherein the shotgun is provided with a barrel and wherein the device comprises an adapter shaft having a longitudinal bore extending therethrough, said adapter shaft having a first end adapted to be received in the barrel of the shotgun and a second end opposite from said first end and upon which is mounted a disc-shaped shield plate, a cylindrical male launching tube mounted on a side of said shield plate opposite from said adapter shall and having an external diameter larger than that of said adapter shaft, said male launching tube having a longitudinal bore therethrough, the longitudinal bore of said male launching tube being of larger diameter than the longitudinal bore of said adapter shaft and communicating with the longitudinal bore of said adapter shaft through said shield plate, a projectile adapted to fit over said male launching tube, whereby, when a blank is fired in said shotgun, the projectile will be launched away from the male launching tube so that a retriever can associate the firing of the blank with the launching of the projectile.

2. A launching device as set forth in claim 1 wherein the projectile comprises a cylindrical female launching tube having an internal cylindrical opening therein slightly larger than the external diameter of said male launching tube, said female launching tube having an opening at one end thereof adapted to fit over said male launching tube and having a locking blast plate affixed to an end thereof opposite from said one end, the female launching tube being molded inside an outer shell which is shaped so as to resemble a game bird.

3. A launching device as set forth in claim 1 wherein the external portion of said male cylindrical launching tube is provided with a circumferential groove in which is received an "O"-ring whereby the "O"-ring will be compressed by the inside surface of a female cylindrical launching tube to provide a snug but not binding fit between the male cylindrical launching tube and the female cylindrical launching tube.

4. A launching device as set forth in claim 1 wherein the shotgun is of the type having an interchangeable choke system, said shotgun having an internal threaded socket in said barrel for receiving said interchangeable choke system, and wherein said first end of said adapter shaft is provided with an external threaded socket which is adapted to mate with the internal threaded socket of the shotgun barrel when the interchangeable choke system has been first removed.

5. A launching device as set forth in claim 4 wherein the external portion of said male cylindrical launching tube is provided with a circumferential groove in which is received an "O"-ring whereby the "O"-ring will be compressed by the inside surface of a female cylindrical launching tube to provide a snug but not binding fit between the male cylindrical launching tube and the female cylindrical launching tube.

* * * * *